US005173324A

United States Patent [19]

Newhart

[11] Patent Number: 5,173,324

[45] Date of Patent: Dec. 22, 1992

[54] METHOD FOR MAKING UNIQUE GRAPHIC PRINTS

[76] Inventor: Catherine Newhart, 606 25th Ave. S., St. Cloud, Minn. 56301

[21] Appl. No.: 403,402

[22] Filed: Sep. 6, 1989

[51] Int. Cl.[5] ..... B44C 1/22

[52] U.S. Cl. ..... 427/11; 427/273; 428/29; 428/195; 428/542 B

[58] Field of Search ..... 428/195, 29, 195, 542.8, 428/916; 427/11, 264, 273; 156/154; 283/72, 102; 434/85, 346

[56] References Cited

U.S. PATENT DOCUMENTS

| | | | |
|---|---|---|---|
| 4,111,734 | 9/1978 | Rosenfeld | 428/204 X |
| 4,158,073 | 6/1979 | Schneider et al. | 428/204 X |
| 4,284,453 | 9/1981 | Endrizzi | 427/264 X |
| 4,321,105 | 3/1982 | Melonio et al. | 430/310 X |
| 4,521,495 | 6/1985 | Hahn, Jr. | 428/537.1 |
| 4,868,020 | 9/1989 | Grosslight | 428/29 |
| 5,089,351 | 2/1992 | Baarns | 428/488.1 |

OTHER PUBLICATIONS

Embossing on Strathmore, the Extra Dimension–4 pages.

*Primary Examiner*—Henry F. Epstein
*Attorney, Agent, or Firm*—Baker, Maxham, Jester & Meador

[57] ABSTRACT

A unique hand made graphic artwork print on a paper sheet with a manually hand embossed three dimensional design and a unique coloring process which is transferred to the sheet by hand with a burnisher. A kit for making the prints includes water repellent sheets for making embossing patterns, a hand burnisher, water absorbent art paper, a plastic backing sheet, a plastic area piece, and may include several water soluble pigments in stick form, water soluble felt tips, a water sprayer, colored sheets and envelopes, glue, pencil, and instructional materials for correct and effective use of the aforesaid materials. A method of making the novel graphic artwork print includes the steps of applying dry water soluble pigments upon one or more water repellent embossing patterns, wetting the applied pigment, and manually burnishing the paper over the pigment and patterns to produce the unique embossed graphic artwork print where the paper removes a portion of the pigment when lifted from the colored pattern.

11 Claims, 3 Drawing Sheets

METHOD FOR MAKING UNIQUE GRAPHIC PRINTS

BACKGROUND OF THE INVENTION

1. Field of the Invention

This invention pertains to a unique graphic print having a relief area, to a new kit for producing new and unique three dimensional graphic prints by hand, and to a method for forming the new and unique graphic prints.

2. The Prior Art

There are vast quantities of printing processes known and used for repetitive production of graphic prints in limited or extended mass production quantities. All of these processes produce essentially identical prints, specifically, the last one produced is identical to the first. These processes all require mechanical equipment for creating any dimensional quality.

Photographic processes are also used to make prints.

OBJECTS OF THE INVENTION

It is an object of this invention to provide a unique graphic print having three dimensional surface and structure and unique coloration.

It is an object of this invention to provide a unique graphic print having unique coloration applied to it using ordinary water as a pigment vehicle together with non-toxic water soluble pigments.

It is an object of this invention to provide a new kit of components for devising unique graphic prints.

It is an object of this invention to provide a new method of devising graphic prints.

It is an object of this invention to provide a unique graphic print devised by a new process.

It is an object of this invention to provide a new apparatus and method for devising original and unique artwork with the apparatus and method being non-toxic and using readily available low cost materials, and being usable in homes, schools and businesses by children, students, artists, franchises and others, for enjoyment by all.

SUMMARY OF THE INVENTION

A graphic print on a sheet of absorbent material is created by hand embossing over unique hand cut hydrophobic sheets of planar material stuck down on a similar hydrophobic backing sheet. Colored pigment is transferred from the above mentioned stuck down materials which have been colored on the top surfaces only by use of colored water soluble coloring sticks or other similar pigments, which pigments are wetted by misting with a hand mister (spray bottle) and then the paper is placed face-side down over the colored design, secured in place, and the colors are burnished and transferred by hand onto the front of the paper graphic print. When the paper is withdrawn at least a portion of the pigment comes off the pattern, appearing on the sheet. The thus embossed, dimensional paper print may be used as a greeting card or for framing. Multiple levels can be created by sticking down different layers and coloring them, so the finished piece would be multicolored, dimensional and unique.

A kit for making graphic prints having both three dimensional forms and color has a water repellant embossing pattern, a dry and water soluble pigment in stick form, and a program for applying dry pigment upon the pattern, wetting the applied pigment, and pressing sheet material upon the wetted pigment and pattern to devise the graphic print.

Many other advantages, features and additional objects of the present invention will become manifest to those versed in the art upon making reference to the detailed description and accompanying drawing in which the preferred embodiment incorporating the principles of the present invention is set forth and shown by way of illustrative example.

DESCRIPTION OF THE PREFERRED EMBODIMENTS

Figure 1:
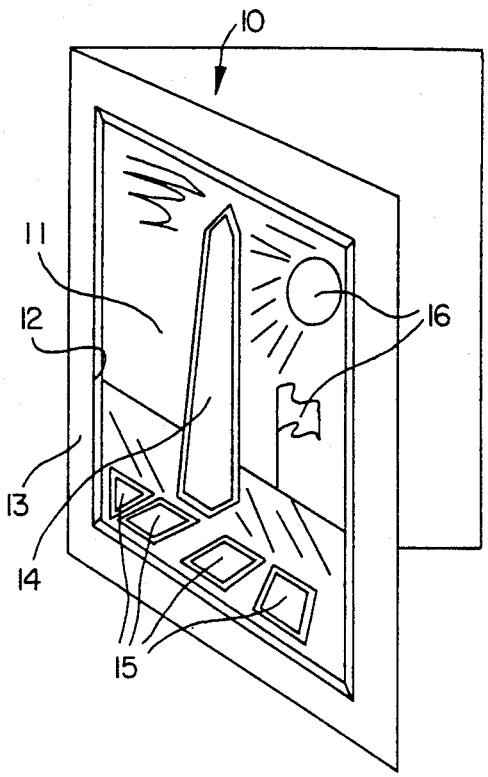
FIG. 1 is a preferred graphic artwork print according to this invention.

FIG. 1 is an illustration of the graphic artwork print of the present invention which is generally indicated by the numeral 10. The print 10 is shown on a greeting or announcement card but can be a stand-alone single plain piece of art. The print 10 as shown is intended to be a facsimile of the Washington Monument and a multiple level or three dimensional structure with a recessed center panel 11 bounded by a crease line 12 and a raised boundary margin 13. Within the recessed panel 11 are a raised section 14 to represent the monument, and a secondary raised section 15 for supplemental features. The print 10 also has pigmented color artwork 16 such as the sun, flag, sky, and ground which are shown for example.

Figure 2:
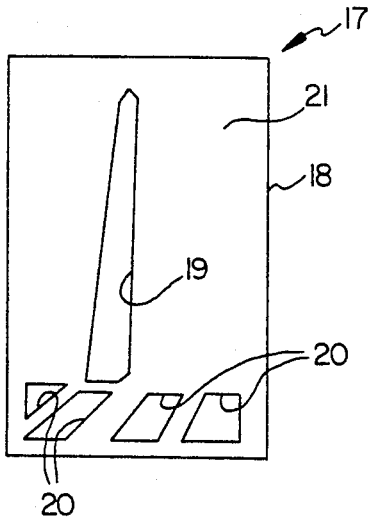
FIG. 2 is plan view of a pattern for making the print of FIG. 1.

FIG. 2 is the embossing pattern 17 for making the print 10. The pattern 17 has an outer perimeter 18, a primary inner aperture 19 representative of the monument, and secondary apertures 20. The pattern 17 is hydrophobic and will not absorb water. The pattern 17 repels water. The pattern 17 is preferably a relatively thin flat plastic sheet having a thickness in the range of 0.015 to 0.62 inches (0.4 to 1.5 mm) thick. Preferred plastic materials for the pattern 17 include polyethylene, polypropylene and similar materials. The surface 21 is shown glossy or flat, but may be textured to produce textural embossing of the panel 11.

Figure 3:
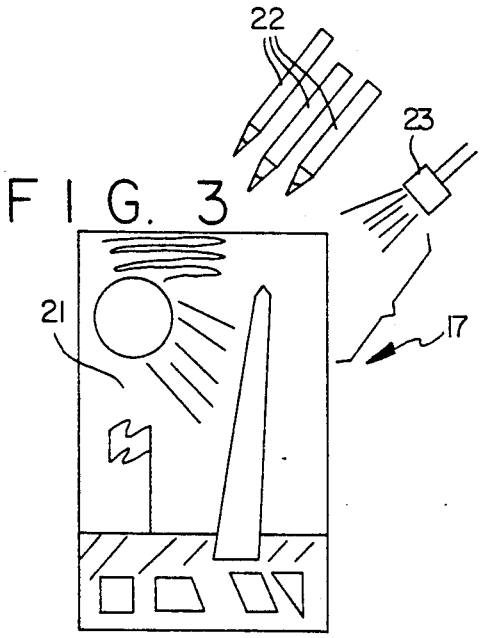
FIG. 3 is a further view of the structure of FIG. 2.

FIG. 3 shows the opposite side of pattern 17, which is transparent, and together with at least one and preferably a plurality of pigment sticks 22 for coloring the pattern 17. The pigment sticks 22 are preferably either pencils or crayons and have a dry color pigment which is in solid form and which is water soluble. The pigment sticks 22 are used to apply dry color pigment upon the pattern surface 21 manually, and as original and unique artwork as devised by the person doing the work. As illustrated and shown, there are the sun, sky, land and flag. When application of the dry pigment is completed, the pigment covered surface 21 of the pattern is wetted with water from a sprayer 23.

Figure 4:
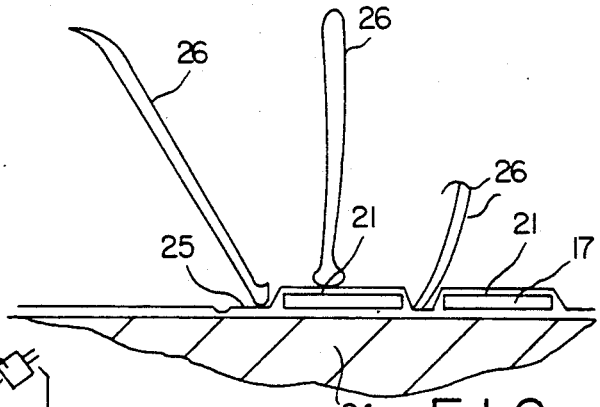
FIG. 4 is an end elevational view of the making of the print of FIG. 1.

FIG. 4 illustrates the pigmented and wetted pattern 17 sitting upon a work surface 24 such as a table. The pigmented and wetted surface 21 is facing up. A sheet 25 of suitable water absorbent material, such as deckled art paper, is placed atop of the pattern 17. A manual burnishing tool 26 is used to press the sheet 25 upon the wetted pigment, and then around the perimeter 18 and into the apertures 19, 20 to emboss the sheet and give the three dimensional structure illustrated in FIG. 1. When the sheet 25 is removed from the pattern 17, the sheet 25 will have lifted at least a portion of the pigment and shall have taken the embossed form of pattern 17. As devised in FIG. 4, the print 10 will have uncolored raised sections 14, 15.

Figure 5:
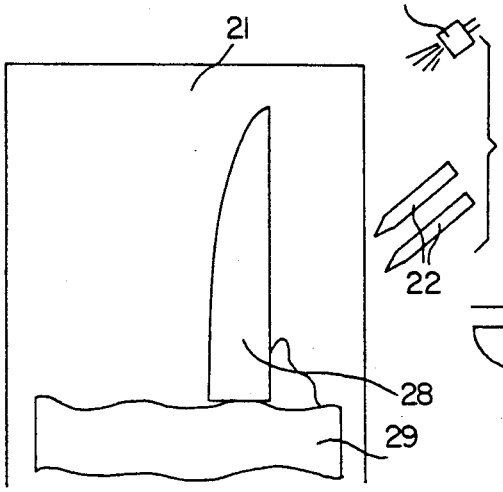
FIG. 5 is a user unique pattern plate for use with the pattern of FIG. 2.

FIG. 5 illustrates an imperforate pattern plate 27 of the same material as the pattern 17. Pigment sticks 22 are used to manually apply dry pigment in one or more colors upon the plate 27. A primary pigment area 28 is positioned to register with the primary aperture 19 and a secondary pigment area 29 to register with the secondary aperture 20. The pigmented plate 27 is then wetted with water from the sprayer 23.

Figure 6:
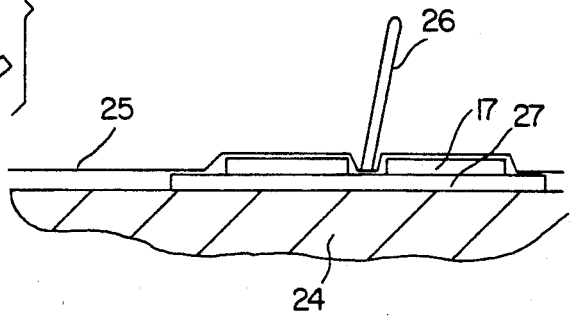
FIG. 6 is an end elevational view of the usage of the plate of FIG. 5.

FIG. 6 illustrates the plate 27 upon the work surface 24 with the wetted pigmented plate facing up. The pattern 17 is placed on top of the plate 27 with the wetted pigment on the pattern facing up. The sheet 25 is then pressed and embossed with the burnisher 26 as previously described. The primary and secondary raised areas 14, 15 now lift at least a portion of the pigment off of the plate 27 and become colored. If the pattern 17 is pigmented, the recess 11 will be colored but if all of the pattern 17 is not pigmented, the recess 11 will not be colored. This is a matter of choice for the design of the print 10.

Figure 7:
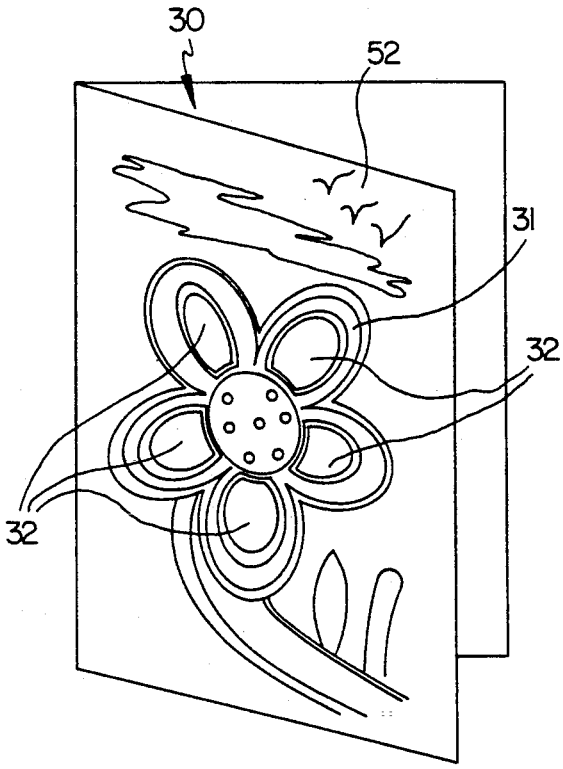
FIG. 7 is an alternative preferred graphic print according to this invention.

FIG. 7 shows an alternative graphic print 30 having a floral design. The design could be an animal, person or any object and the flower is selected merely for simplicity of explanation of the invention structures and process. The print 30 has a recessed flower section 31 with an irregular border that suggests flower petals. Internal raised areas 32 may be provided within the recessed area 31. The remaining surface of the print 30 is shown with colored graphics of at least one and preferably a plurality of colors which represent a plant stem and clouds, for example.

Figure 8:
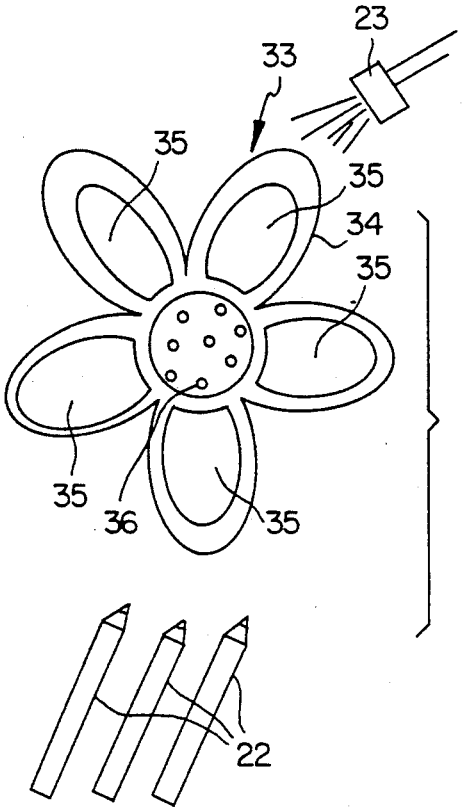
FIG. 8 is a pattern for making the print of FIG. 7.

FIG. 8 shows the pattern 33 having a perimeter 34 which represents something, in this case a flower profile. Internal primary apertures 35 provide for three dimensional embossing and secondary apertures 36 enable artwork influence and/or embossing. The pigment sticks 22 are used to manually apply dry water soluble pigment in a novel and unique configuration upon the pattern 33 in at least one and usually several colors. The print 30 can then be pressed and embossed as previously described and produce the pattern designed, colored, and without the artwork shown on the print 30. Whereas the first pattern 17 is a "negative" style, the alternative pattern 33 is a positive style.

Figure 9:
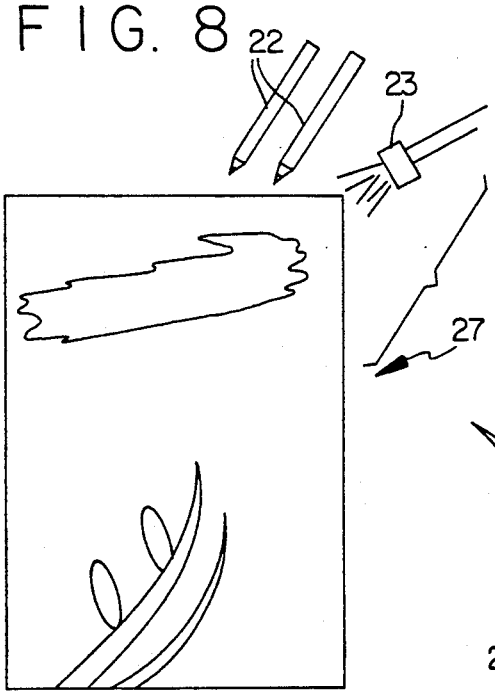
FIG. 9 is another view of the plate of FIG. 5.

FIG. 9 illustrates the imperforate pattern plate 27 upon which the alternative stem and cloud graphics are manually devised with dry pigment from the pigment sticks 22. These graphics are likewise wetted with the sprayer 23.

Figure 10:
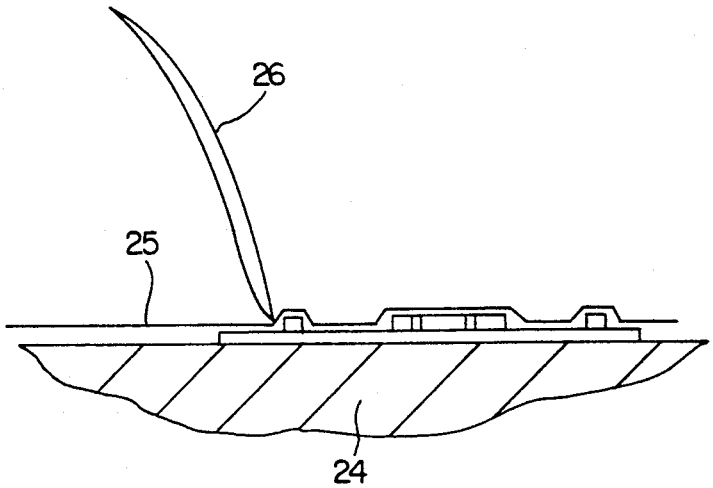
FIG. 10 is an end elevational view of the making of the print in FIG. 7.

FIG. 10 then illustrates the plate 27 being under the pattern 33 and the sheet 25 being pressed against the pattern 33 and the wetted pigments with the burnisher 26 to produce the embossing and to make the sheet 25 lift at least a portion of the pigment off of the pattern 33 and plate 27.

Figure 12:
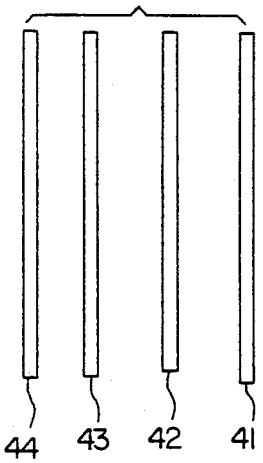
FIG. 12 is a side view of the patterns for making the print of FIG. 11.
Figure 11:
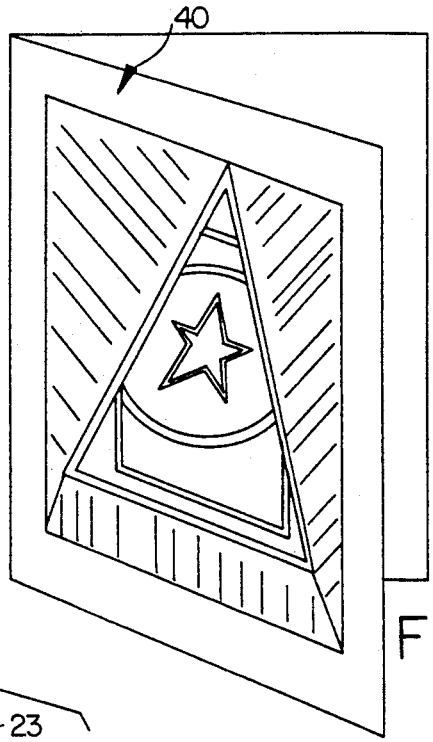
FIG. 11 is another alternative preferred graphic print according to the present invention.
Figure 13:
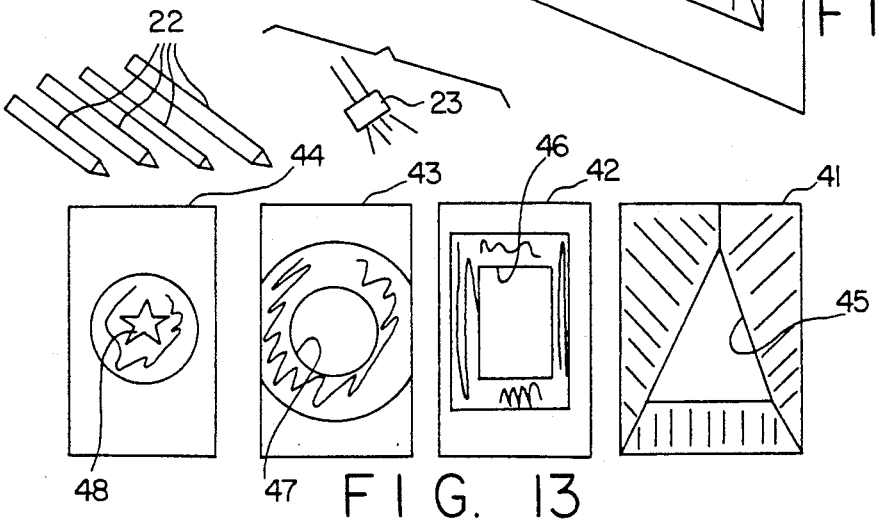
FIG. 13 is a plan view of the patterns of FIG. 12.
Figure 14:
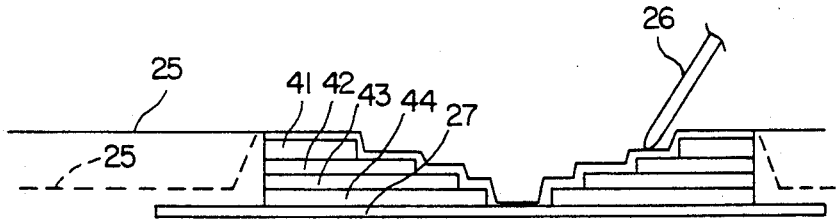
FIG. 14 is an end elevational view of the making of the print of FIG. 11.

FIG. 11 illustrates an alternative graphic print 40 having a multiple level three dimensional embossed/-debossed design together with colored artwork on one or more or even all of the levels of the print 40. A group of four patterns 41, 42, 43, 44 are shown in FIGS. 12 and 13. Pattern 41 has one or more profiles or apertures 45 for a predetermined feature, pattern 42 has one or more profiles or apertures 46 for a predetermined feature and so on with profiles 47 and 48 in patterns 43 and 44. Each of these patterns and the pattern plate 27 may be pigmented with sticks 22 as previously described. The plate 27 and patterns 41, 42, 43, 44 are then wetted as previously described and stacked in registry as shown in FIG. 14. The sheet 25 is then placed on top of the stack of patterns 41, 42, 43, 44 and plate 27 and pressed with the burnisher 26 to provide multiple level embossing and pigment pickup. The patterns 41, 42, 43, 44 are shown as negative style and these will produce a convex embossed structure in the print 40. Positive type patterns 41, 42, 43, 44 will produce a concave embossed structure in the print 40. It is a matter of choice.

Figure 15:
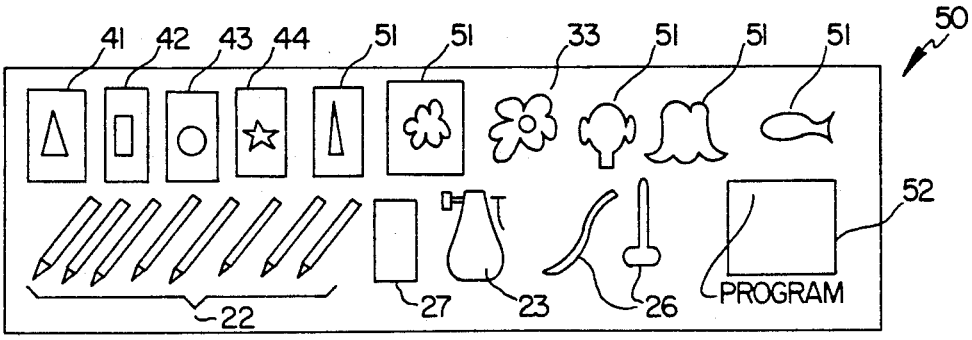
FIG. 15 is a plan view of the kit of the present invention.

FIG. 15 shows an example of a relatively complete kit, generally indicated by the numeral 50, to practice the method of this invention and to produce the new and unique prints 10, 30, 40. The kit 50 may have a diverse plurality of the patterns 33, 41, 42, 43, 44 and other patterns 51, the pattern plate 27, a wide variety of the pigment sticks 22, one or more burnishers 26, the sprayer 23, and a program 52 defining the operational sequence previously defined herein, which is to be adhered to for the devisement of the new prints 10, 30, 40 and practice of the method of this invention.

Be it understood that the patterns each produce a predetermined and specific embossed profile. The patterns shown are merely for example, and can include such things as flags, flowers, animals, fish, trees, mountains, plants, celestial bodies, symbols, logos, trademarks, crests, seals, images, likenesses, vehicles, geometric configurations and so on. The pattern plate 27 can be used by itself as a pattern per se and can carry all of the graphics.

The graphics applied by the pigment sticks are unique and are devised by the user of the kit 50. There is no limit. However, every print removes at least part of the applied pigment and consequently, every print is different and unique. A first print is commonly made, and more pigment is added and wetted for making a subsequent print and these prints are further different and unique, in the manner of snowflakes.

The pigmented patterns can be stacked or layered one on top of the other to produce all kinds of results. As an example, the prints of FIG. 11 can be a crest or logo of an organization. Various patterns can be stacked to give outdoor scenes.

Manual highlining of outline and fine things such as bird highlining 52 in FIG. 7 can be added to further make each print unique and a work of art.

This kit 50 and method enables almost any person to become a capable artist who can produce unique graphic prints for artwork per se, greeting cards, awards, invitations and so forth. There are no toxic or dangerous chemicals used, and the results are gorgeous.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A method of making a unique graphic embossed art print comprising the steps of:

(a) creating an embossing pattern on a sheet of hydrophobic material;

(b) applying at least one dry and water soluble pigment upon a first surface of said pattern;

(c) wetting said applied pigment with water;

(d) providing a water absorbent sheet of art paper;

(e) placing said art paper sheet against said wetted and pigmented pattern surface;

(f) hand burnishing said art paper sheet against said pigment and over said pattern, thereby embossing the form of said pattern in relief into said art paper sheet and pressing the wetted pigment into said art paper sheet; and then (g) withdrawing at least part of the wetted pigment from said pattern by removal of the now embossed art paper sheet from the pattern, to provide both a three dimensional form and color in the print upon said art paper sheet.

2. The method of claim 1, including the further steps of applying dry pigment upon a plurality of said patterns, wetting the pigments, stacking said wetted pigmented patterns and pressing said sheets against all of said stacked patterns to simultaneously form multilevel, colored, embossed prints.

3. The method of claim 2, in which each said pattern has a distinctive profile, and in which each said pattern is individually pigmented.

4. The method of claim 1, in which the pigment is provided in stick form and is manually applied upon the pattern.

5. The method of claim 1, including the further step of applying a second water soluble pigment upon the pattern, and in which said pigments overlap each other.

6. The method of claim 1, in which the pigment is rewetted and a second sheet is pressed against the wetted pigment and the pattern, and a second print is made with similar but unique pigmentation.

7. The method of claim 6, in which further pigment is added to the pattern in between successive pressings, each print being similar but unique.

8. The method of claim 7, in which the pigment is manually applied upon the pattern, in which the sheet is manually pressed against the pattern and the pigment, and including the further step of manually highlighting the print after removal from the pattern and the pigment.

9. The method of claim 1, in which a plurality of different color pigments are provided in stick form and are manually applied upon the pattern to create a unique color arrangement to be printed with a predetermined and fixed embossing pattern, said step of pressing being manually implemented.

10. A process of making water based prints comprising the steps of:

(a) applying dry water soluble pigment in stick form frictionally upon a hydrophobic surface;

(b) wetting said applied pigment and said surface with water;

(c) placing a water absorbent print sheet upon said wetted pigment and surface;

(d) selectively hand burnishing said sheet against said wetted pigment and surface, thereby embossing the print onto said sheet; and (e) separating said sheet from said surface, thereby lifting at least part of the wetted pigment off of said surface with said sheet, thereby forming a water base pigmented embossed print upon said sheet.

11. A method of making a unique graphic embossed art print comprising the steps of:

(a) creating a three dimensional embossing apttern from a sheet of hydrophobic material;

(b) applying pigment to said sheet;

(c) providing a sheet of art paper and placing said art paper sheet against said embossing pattern;

(d) hand burnishing said art paper sheet against said embossing pattern, thereby embossing the form of the pattern into the sheet; and then (e) removing the embossed art paper sheet from the pattern to provide a unique three dimensional form in the print upon said art paper sheet.

* * * * *